US005492044A

United States Patent [19]

Sperzel

[11] Patent Number: 5,492,044

[45] Date of Patent: Feb. 20, 1996

[54] STRING SUPPORT HAVING A BASE WITH STRING SUPPORT MEMBERS AND METHOD

[76] Inventor: Robert J. Sperzel, Marine Tower-East, Unit 1503, 12520 Edgewater Dr., Lakewood, Ohio 44107

[21] Appl. No.: 106,360

[22] Filed: Aug. 13, 1993

Related U.S. Application Data

[63] Continuation-in-part of Ser. No. 68,122, May 25, 1993, Pat. No. 5,394,783, which is a continuation-in-part of Ser. No. 963,074, Oct. 19, 1992, abandoned.

[51] Int. Cl.[6] ..... G10D 3/00; G10D 3/06

[52] U.S. Cl. ..... 84/297 R; 84/314 N

[58] Field of Search ..... 84/297 R, 298, 84/299, 307, 308, 309, 314 N

[56] References Cited

U.S. PATENT DOCUMENTS 4,304,163 12/1981 Siminoff ..... 84/314 N 5,173,565 12/1992 Gunn ..... 84/298

5,260,504 11/1993 Turner ..... 84/297 R

*Primary Examiner*—Cassandra C. Spyrou

*Attorney, Agent, or Firm*—Tarolli, Sundheim & Covell

[57] ABSTRACT

A stringed musical instrument of the guitar type has a plurality of strings which extend from tuning devices on a head portion, along a neck portion, to a body portion of the instrument. A string support includes a base which extends beneath the strings. A plurality of spheres have lower segments which are disposed in apertures in the base. The base is positioned in a groove with centers of curvature of the spheres in a plane which contains a flat front side surface of the groove. Positioning members engage the bottom of the groove to locate the base relative to the groove. The base can be resiliently deflected to have a curvature which is the same as the curvature of an upper side surface of the neck portion of the guitar. To facilitate deflection of the base, slots are formed part way through the base. To enable the position of the base to be adjusted relative to the groove when the base is in the groove, the positioning members are accessible from an upper side of the base.

57 Claims, 4 Drawing Sheets

STRING SUPPORT HAVING A BASE WITH STRING SUPPORT MEMBERS AND METHOD

RELATED APPLICATION

This application is a continuation-in-part of Application Ser. No. 08/068,122, filed May 25, 1993 by Robert J. Sperzel and entitled "String Support and Method" now U.S. Pat. No. 5,394,783 which is a continuation-in-part of Application Ser. No. 07/963,074, filed Oct. 19, 1992, by Robert J. Sperzel and entitled "String Support for Musical Instrument now abandoned". The benefit, under Title 35, United States Code S120 of the earlier filing dates of the aforementioned Applications Ser. Nos. 07/963,074 and 08/068,122 has been and hereby is claimed for all subject matter common to this application either one of the aforementioned application Ser. Nos. 07/963,074 and/or 08/068,122.

BACKGROUND OF THE INVENTION

The present invention relates to a new and improved string support assembly for use with a guitar or similar stringed instrument to position strings relative to the instrument.

Stringed musical instruments of the guitar type commonly have a body portion, a neck portion which extends outwardly from the body portion, and a head portion connected with an end of the neck portion opposite from the body portion. A plurality of tuning devices are mounted on the head portion and are operable to adjust the tension in strings which extend from the head portion along the neck portion to the body portion of the instrument. A nut or string support system is provided adjacent to a connection between the head and neck portions of the instrument. The nut positions the strings relative to the neck portion of the instrument.

The manner in which the nut cooperates with the strings is very important in obtaining the desired tone from the instrument. Thus, the nut must be accurately located to determine the effective length of the strings. The nut must hold the strings against sidewise movement in order to avoid a buzzing sound effect. During the operation of a tremolo, the nut should allow the tension in the strings to be varied in a predictable manner. The nut should be constructed in such a manner as to enable a uniform spacing to be obtained between each of the strings and the frets on the neck of the guitar.

In the past, the nut has included a straight piece of material in which slots are formed. Substantial care and effort is required to form the slots in the nut with a width which corresponds exactly to the diameter of the strings to prevent sidewise movement of the strings. In addition, the orientation of the slots must be carefully and accurately determined to have the strings go straight back from a front edge of the nut to the tuning devices on the head portion of the guitar. In addition, substantial effort must be expended to form the slots with a depth which will result in each of the strings being spaced the same distance from an arcuate upper side surface on each of the frets on the neck of the guitar. Unfortunately, after the guitar is used over a period of time, the nut wears and must be replaced.

SUMMARY OF THE INVENTION

An improved string support is used in a musical instrument of the guitar type. This type of musical instrument commonly has a plurality of strings which extend from tuning devices on a head portion, along a neck portion, to a body portion of the instrument. The improved string support positions the strings relative to the head and neck portions of the instrument.

In one embodiment of the invention, the string support includes a base which extends beneath the strings. A plurality of spheres are disposed on the base and have lower segments which are disposed in apertures formed in the base. Each of the spheres has a center of curvature which is disposed in a plane containing a side surface area of a groove in which the base is disposed on the instrument. Positioning members extend from the base and engage a bottom of the groove to locate the base relative to the groove. The base may be deflected to have a curvature which corresponds to the curvature of an upper side surface of the neck portion of the instrument.

In another embodiment of the invention, a separate base is provided for each pair of spheres. Each of the bases includes a positioning member which locates the base relative to the musical instrument.

BRIEF DESCRIPTION OF THE DRAWING

The foregoing and other features of the present invention will become more apparent upon a consideration of the following description taken in connection with the accompanying drawings, wherein.

DESCRIPTION OF SPECIFIC PREFERRED EMBODIMENT OF THE INVENTION

General Description

Figure 1:
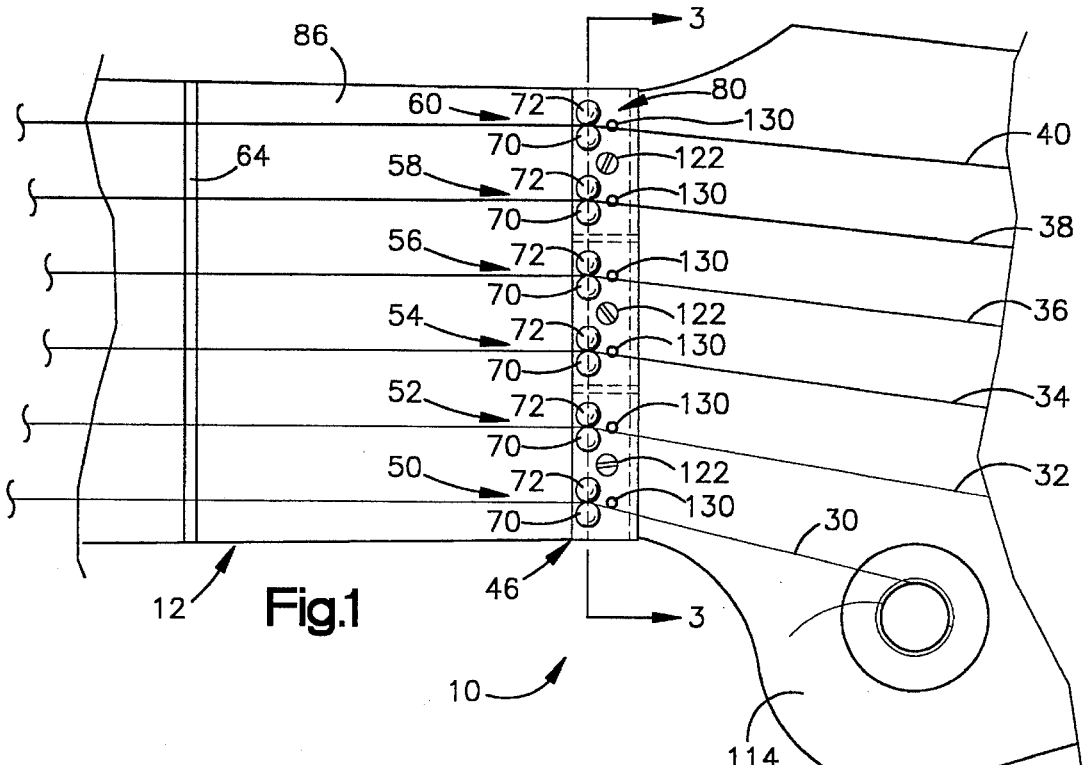
FIG. 1 is a fragmentary and somewhat schematicized plan view illustrating the relationship between a neck portion, head portion and a plurality of strings in a musical instrument of the guitar type.

A portion of a musical instrument 10 is shown in FIG. 1. The musical instrument 10 is a guitar and includes a body portion (not shown) having a sounding board. A neck portion 12 extends outward from the body portion of the musical instrument 10. A head portion 14 is connected with the neck portion 12. The head and neck portions 12 and 14 are formed of wood. However, the head and/or neck portions 12 and 14 could be formed of a different material if desired.

A plurality of tuning devices, one of which is indicated at 16 in FIG. 1, are provided on the head portion 14. The tuning devices are operable to adjust the tension in strings 30, 32, 34, 36, 38 and 40 in a known manner. The tuning devices are advantageously constructed in the manner disclosed in U.S. Pat. No. 4,625,614.

The strings 30–40 extend from the tuning devices on the head portion 14 along the neck portion 12 of the guitar to the body portion of the guitar. A tremolo may be provided on the body portion to vary the tension in the strings 30–40 in a known manner. The general construction of the musical instrument 10 is well known and may be in accordance with the construction of any one of many different commercially available guitars.

An improved string support assembly 44 constructed in accordance with the present invention is provided adjacent to a connection 46 between the neck and head portions 12 and 14 of the musical instrument 10. The string support assembly 44 positions the strings 30–40 relative to the neck portion 12 of the musical instrument 10. The string support assembly 44 performs functions performed by a nut in known guitars.

The improved string support assembly 44 includes a plurality of identical string supports 50, 52, 54, 56, 58 and 60 (FIGS. 1 and 3) which are disposed in a linear array. There is a string support 50–60 for each of the strings 30–40. The string supports 50–60 engage the strings to locate them relative to each other and to frets 64 on the neck portion 12 of the guitar 10.

Figure 2:
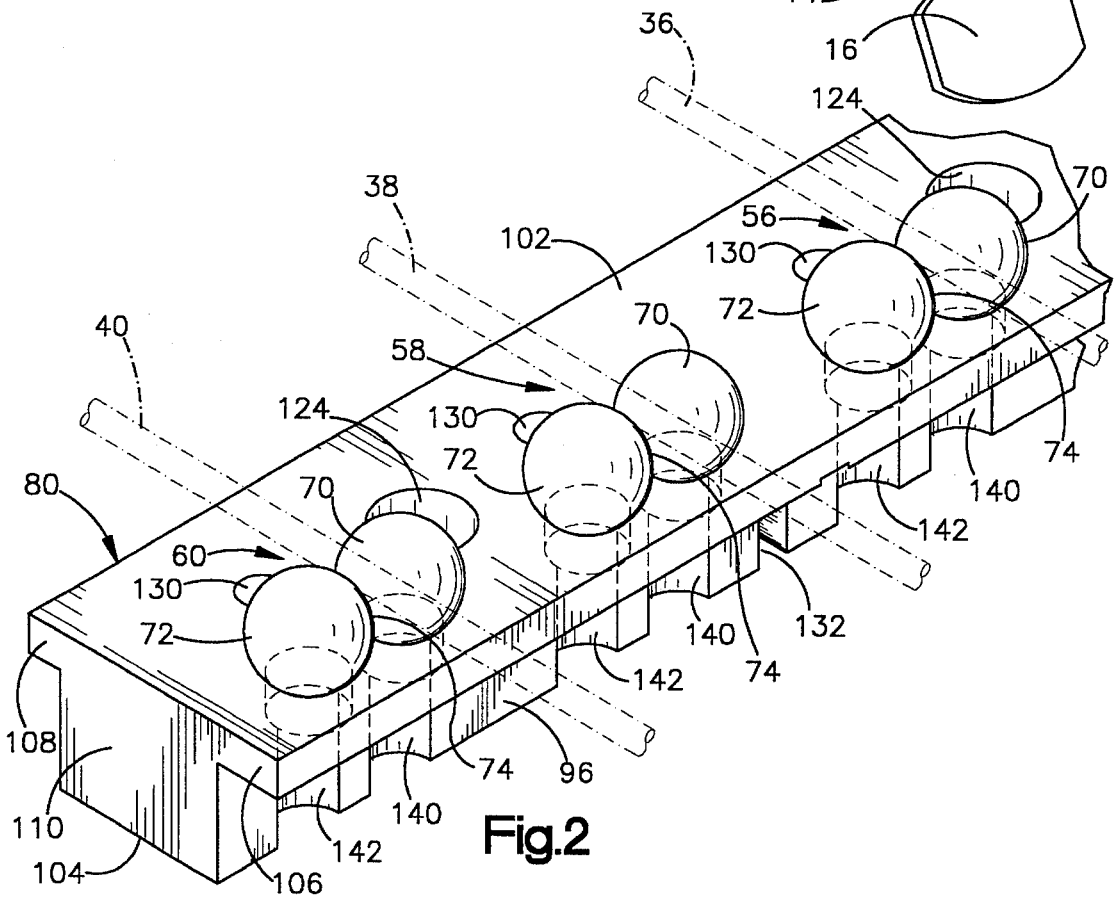
FIG. 2 is an enlarged pictorial illustration of a portions of a string support constructed in accordance with the present invention.
Figure 3:
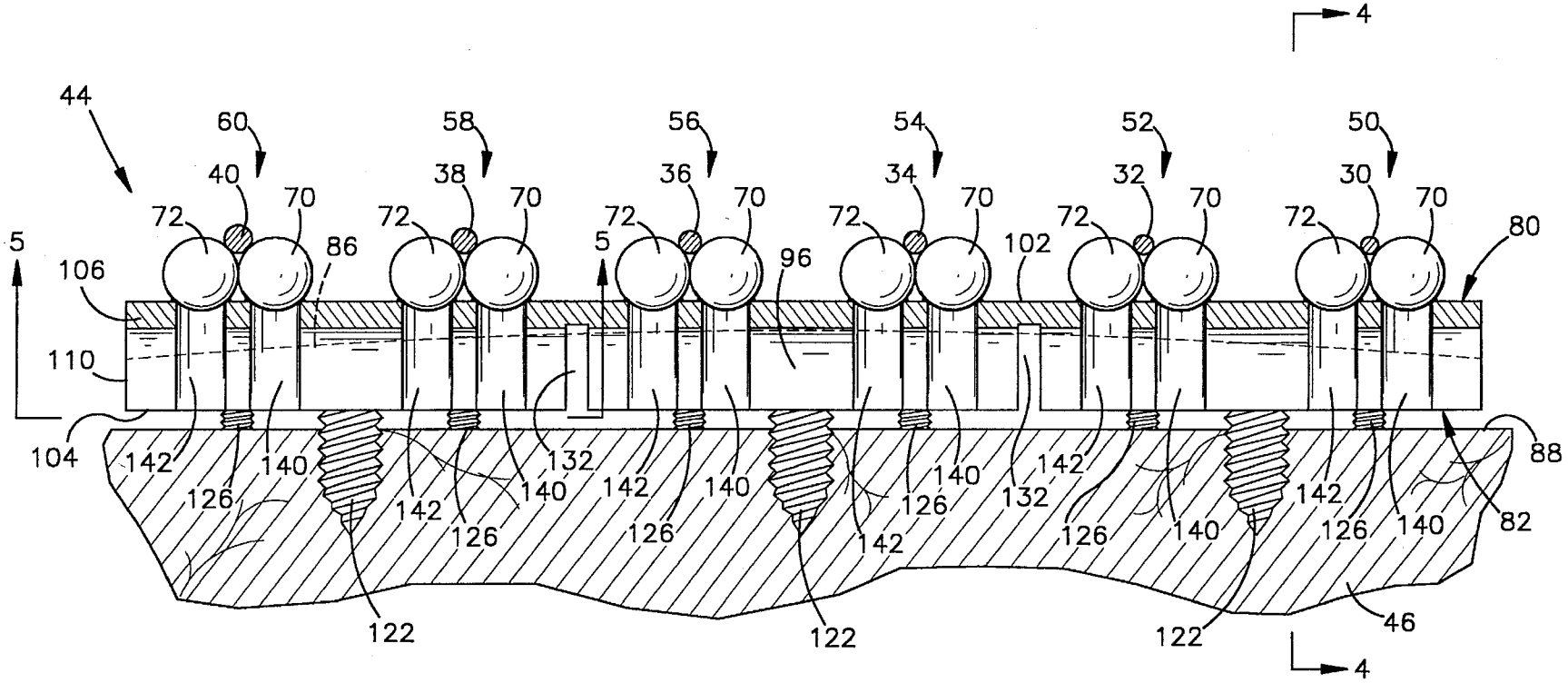
FIG. 3 is a sectional view, taken generally along the line 3—3 of FIG. 1, illustrating the relationship between a base and a plurality of spheres used in the string support, the base being shown in an initial or undeflected condition in FIG. 3.

In accordance with one of the features of the present invention, each of the string supports 50–60 includes a pair of spheres or balls 70 and 72 (FIGS. 1, 2 and 3). The spheres 70 and 72 of each pair of spheres are formed of metal (steel) and have convex arcuate surfaces which support one of the strings 30–40 (FIG. 1). Although it is preferred to use a pair of spheres or balls 70 and 72 in each of the string supports 50–60, a pair of nonspherical members could be formed with convex arcuate surface areas which are engaged by one of the strings 30–40.

The spheres 70 and 72 enable each of the strings 30–40 to be supported at a predetermined location along the neck 12 of the musical instrument 10 to provide an accurately located intonation point for the string. The spheres 70 and 72 also accurately locate the strings 30–40 relative to the frets 64 (FIG. 1) on the neck portion 12 of the musical instrument 10.

In addition to accurately locating the strings 30–40, the spheres 70 and 72 cooperate with the strings to hold them against sideways movement at the string support assembly 44. This minimizes objectionable noise or buzzing. The convex arcuate outer side surfaces of the spheres 70 and 72 enable the strings 30–40 to extend in either a continuous straight line along the neck portion 12 and head portion 14 or to bend at the string support assembly 44. This enables the string supports 50–60 to be used with guitars having tuning devices at almost any desired location on the head portion of the guitar.

The spheres 70 and 72 in the string supports 50–60 enable the strings 30–40 to have different diameters. Thus, the diameters of the strings 30–40 progressively increase from a relatively small diameter string 30 to a relatively large diameter string 40. The reason that the identical string supports 50–60 can be used with the strings of different diameters is that the convex arcuate outer side surfaces of the spheres 70 and 72 cooperate to form a recess or nip 74 (FIG. 2) which tapers downwardly (as viewed in FIG. 2). The tapering nip 74 allows the spheres 70 and 72 to engage opposite sides of strings 30–40 having different diameters and to hold the different diameter strings against sideways movement. The spheres 70 and 72 preferably have diameters which are greater than the diameters of the strings.

The manner in which the spheres 70 and 72 cooperate with the strings 30–50 is the same as is described in the aforementioned U.S. patent Application Ser. No. 07/963,074 filed Oct. 19, 1992 by Robert J. Sperzel and entitled "String Support for Musical Instrument".

String Support Assembly—Base

The string support assembly 44 includes a one-piece metal base 80 (FIGS. 1, 2 and 3) which is constructed and cooperates with the musical instrument 10 in accordance with features of the present invention. The base 80 has a generally rectangular configuration. The base 80 is disposed in a rectangular groove 82 (FIGS. 3 and 4) which extends across the connection 46 between the head and neck portions 12 and 14 of the musical instrument 10 (FIG. 1). The groove 82 has a longitudinal central axis which extends perpendicular to a longitudinal central axis of the neck portion 12 of the musical instrument 10.

The neck portion 12 of the musical instrument has an arcuate upper side surface 86 (FIGS. 1, 3 and 4) which is formed as a portion of a cylinder having a relatively large diameter. Thus, the upper side surface 86 of the neck portion 12 could have a radius of curvature of ten inches or more.

Figure 4:
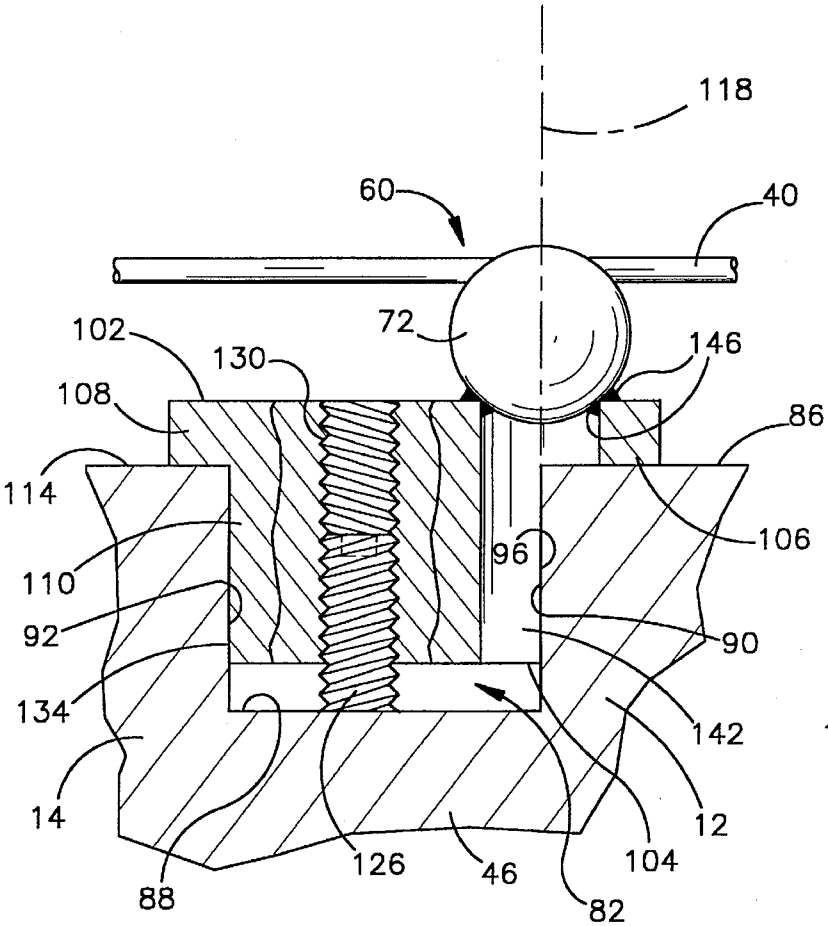
FIG. 4 is an enlarged fragmentary sectional view, taken generally along the line 4—4 of FIG. 3, illustrating the relationship of the base and one of the spheres to a groove formed at a connection between the head and neck portions of the instrument.

Due to the curving configuration of the upper side surface 86 of the neck portion 12, the groove 82 is relatively deep at a central portion of the groove and relatively shallow adjacent to opposite ends of the groove. The groove 82 (FIGS. 3 and 4) has a flat upwardly facing bottom surface 88 which extends beneath the strings 30–40. In addition, the groove 82 has a flat front side surface 90 (FIG. 4). A flat rear side surface 92 of the groove 82 extends parallel to the front side surface 90 and perpendicular to the bottom surface 88. The groove 82 has a longitudinal central axis which extends parallel to the frets 64 and perpendicular to a longitudinal central axis of the neck portion 12.

In accordance with a feature of the invention, the flat front side surface 90 (FIG. 4) of the groove 82 engages a flat front side surface 96 on the base 80 to position the base and spheres 70 and 72 relative to the neck and head portions 12 and 14 of the musical instrument 10. Thus, abutting engagement of the flat front side surface 96 on the base 80 with the flat front side surface 90 on the groove 82 accurately locates the base 80. The groove 82 is cut in the wooden material of the musical instrument 10 at the connection 46 between the neck portion 12 and head portion 14 during formation of slots in the neck portion for the frets 64. Therefore, the groove 82 can be very accurately located at the connection between the neck portion 12 and head portion 14 of the musical instrument.

Figure 5:
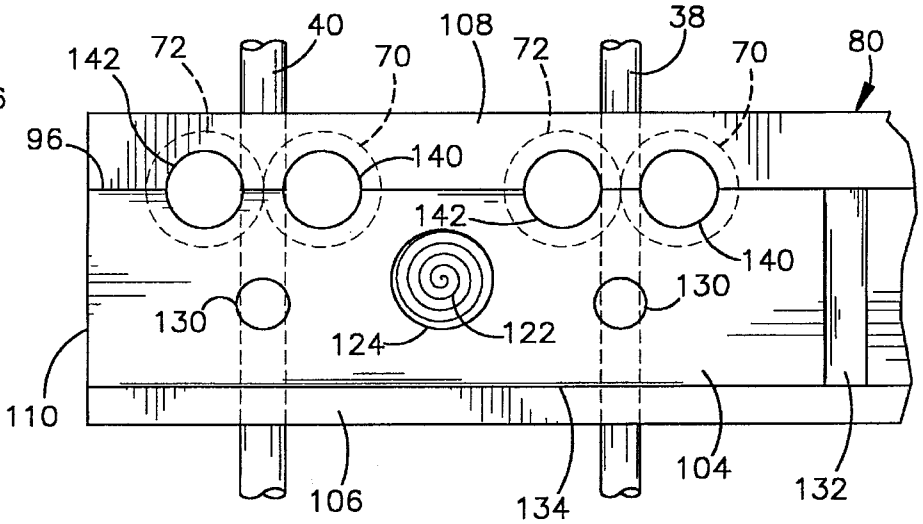
FIG. 5 is a bottom plan view, taken generally along the line 5—5 of FIG. 4, further illustrating the construction of the base.

The base 80 is formed by a single piece of metal (brass) and has a generally rectangular configuration. Thus, the base 80 has a rectangular upper side surface 102. As originally formed, the upper side surface 102 of the base 80 is flat. The base 80 also has a lower side surface 104 (FIGS. 3, 4 and 5). The rectangular lower side surface 104 of the base extends parallel to the upper side surface 102 of the base. The base 80 has front and rear flanges 106 and 108 (FIGS. 3 and 4)

which extend from a main body section 110 (FIG. 2) of the base 80. The front flange 106 extends over the upper side surface 86 of the neck portion 12 of the instrument 10 (FIG. 4). Similarly, the rear flange 108 extends over an upper side surface 114 on the head portion 14 of the instrument 10.

The centers of curvature of the spheres 70 and 72 are disposed in a flat plane 118 which contains the flat front side surface 90 of the groove 82 (FIG. 4). When the base 80 has its original configuration, the centers of curvature of the spheres 70 and 72 are disposed along a straight line which is parallel to the upper side surface 102 of the base. Thus, the flat plane 118 extends through the centers of curvature of the spheres 70 and 72. In addition, the plane 118 contains the flat front side surface 90 on the groove 82. Since the flat front side surface 90 of the groove 82 is accurately located on the instrument 10, the centers of curvature of the spheres 70 and 72 are accurately located on the instrument.

In the illustrated embodiment of the invention, the centers of the spheres 70 and 72 are disposed directly above and are aligned with the flat front side surface 90 of the groove 82. This construction is preferred because the location where the strings 30–40 engage the nips 74 between the spheres 70 and 72 is in the plane 118 of the flat front side surface 90 of the groove 82. This facilitates retrofitting the string support assembly 44 on instruments in which the groove 82 has previously been formed with the flat front side surface 90 of the groove accurately located relative to other portions of the instrument.

However, if desired, the centers of the spheres 70 and 72 could be offset either forwardly or rearwardly by a predetermined distance from the flat front side surface 90 of the groove 82. If this was done, the centers of all of the spheres 70 and 72 would be disposed in a single flat plane which would extend parallel to the flat front side surface 90 of the groove 82. This plane would be offset either forwardly or rearwardly of the flat front side surface 90 of the groove 82.

In the illustrated embodiment of the invention, the base 80 is attached to the instrument 10 by a plurality of screws 122 (FIGS. 1 and 3). The screws 122 extend through cylindrical openings 124 (FIG. 2) which extend through the base 80. The screws 122 engage the wooden material of the instrument 10 at the junction 46 between the head portion 14 and neck portion 12 of the instrument.

In accordance with one of the features of the invention, the base 80 can be moved either upward or downward (as viewed in FIG. 3) to raise or lower the spheres 70 and 72 which support the strings 30–40. Thus, if the distance from the strings 30–40 to the frets 64 is to be increased, the base 80 is moved upward (as viewed in FIG. 3) relative to the neck and head portions 12 and 14 of the instrument 10. If the distance between the strings 30–40 and the frets 64 is to be decreased, the base 80 is moved downward. By enabling the position of the base 80 to be adjusted, the positions of the strings 30–40 can be adjusted to suit the desires of different musicians.

To provide for adjustment of the base 80 and the positions of the spheres 70 and 72, a plurality of externally threaded positioning elements 126 (FIG. 3) extend from the lower portion of the base 80. The positioning elements 126 are received in internally threaded openings 130 (FIG. 4) which extend through the base 80. The external threads on the positioning elements 126 engage the internal threads on the openings 130.

Sockets (FIG. 4) are formed in the upper ends of the positioning elements 126. The sockets are accessible from the upper side of the base 80. Thus, a small tool, such as an allen wrench, can be inserted into the socket to rotate the positioning element 126 relative to the base 80.

Rotating the positioning element 126 relative to the base 80 results in the positioning element being moved axially either into or out of the opening 130. The greater the extent to which the positioning elements 126 extend from the openings 130, the greater is the distance between the lower side surface 104 of the base 80 and the bottom surface 88 of the groove 82 (FIG. 4). Similarly, the smaller the distance which the positioning elements 126 extend outwardly from the openings 130, the smaller the distance between the lower surface 104 of the base 80 and the bottom surface 88 of the groove 82.

The longitudinal central axes of the openings 130 in which the positioning members 126 are located extend parallel to the flat front side surface 96 of the base 80. Therefore, when the positioning elements 126 are extended or retracted, the flat front side surface 96 of the base 80 slides along the flat front side surface 90 of the groove 82. This results in the centers of curvature of the spheres 70 and 72 remaining in the plane 118 as the positioning elements 126 are either extended or retracted. Since the positioning elements 126 are accessible from the upper side of the base 80, the locations of the positioning elements 126 relative to the base 80 can be adjusted when the base is disposed in the groove 82.

Deflection of Base

In accordance with another feature of the present invention, the base 80 can be deflected to have a configuration which corresponds to the configuration of the arcuate upper side surface 86 on the neck portion 12 of the instrument. As was previously described, the upper side surface 86 on the neck portion 12 of the instrument 10 is a portion of an outer side surface of a cylinder. The cylinder has a central axis which extends parallel to a central axis of the neck portion 12 and perpendicular to a longitudinal central axis of the groove 82. The frets 64 (FIG. 1) have upper side surfaces with the same curvature as the upper side surface 86 of the neck portion 12. The upper side surfaces of the frets 64 are all disposed the same distance above the upper side surface 86 of the neck portion 12.

In order to have the distance from each of the strings 30–40 to the upper side surface of a fret 64 be the same, it is necessary to have the centers of curvature of the spheres 70 and 72 located along an arcuate axis having the same curvature as the upper side surface 86 of the neck portion 12 of the instrument. As originally formed, the base 80 has the linear configuration shown in FIG. 3. When the base 80 has its initial linear configuration, the string support 50 and the string support 60 at opposite ends of the base support the strings 30 and 40 a relatively large distance above the frets 64. However, the string supports 54 and 56 at the central portion of the base 80 support the strings 34 and 36 relatively close to the frets 64.

It is believed that most musicians will want to have the strings 30–40 located the same distance from the frets 64. To accomplish this, the base 80 is resiliently deflected from the linear configuration of FIG. 3 to the arcuate configuration of FIG. 6. When the base 80 has been deflected to the arcuate configuration of FIG. 6, the upper side surface 102 of the base will have a configuration which is the same as the configuration of the upper side surface 86 on the neck portion 12 of the instrument 10 and the same configuration as the upper side surface of the frets 64. The centers of curvature of the spheres 70 and 72 are all disposed in the plane 118 at the same distance from the upper side surface 102 of the base 80. Therefore, all the strings 30–40 will be supported substantially the same distance from the upper side surface 86 of the neck portion 12 and the upper side surfaces of the frets 64.

Figure 6:
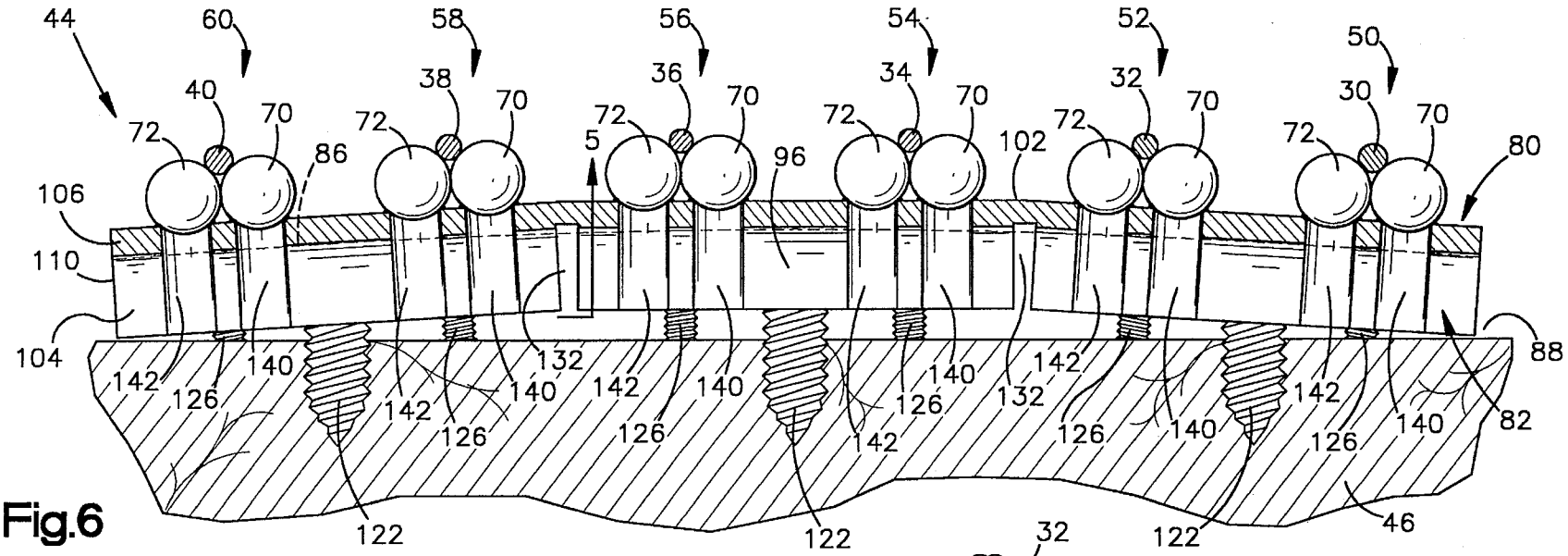
FIG. 6 is a fragmentary sectional view, generally similar to FIG. 3, illustrating the base in a deflected condition in which the curvature of the base corresponds to the curvature of an upper side surface of the neck portion of the instrument.

To deflect the base 80 from the linear configuration of FIG. 3 to the arcuate configuration of FIG. 6, the extents to which the positioning elements 126 project from the base 80 are adjusted to correspond to the desired arcuate configuration of the base. Thus, the positioning elements 126 associated with the string supports 50 and 60 at opposite ends of the base 80, are almost fully retracted. The positioning elements 126 associated with the string supports 54 and 56 at the central portion of the base 80 are extended. The positioning elements 126 associated with the string supports 52 and 58 are extended to a lesser degree than the positioning elements associated with the string supports 54 and 56.

Once the extent to which the positioning elements 126 project from the base 80 has been adjusted, the screws 122 are tightened to press stop surfaces on the ends of the positioning elements 126 against the bottom surface 88 of the groove 82. As this occurs, the base 80 is resiliently deflected from the linear configuration of FIG. 3 to the arcuate configuration of FIG. 6. As the base 80 is deflected, the front side surface 96 of the base remains in flat abutting engagement with the front side surface 90 of the groove 82. Thus, as the base 80 is deflected, the front side surface 96 of the base slides along the front side surface 90 of the groove 82. As the base 80 is deflected, at least some of the spheres 70 and 72 move relative to the neck portion 12.

Through a visual inspection, it is relatively easy to determine whether or not the front flange 106 of the base 80 is pressed into abutting engagement with the upper side surface 86 of the neck portion 12 throughout the length of the front flange. If there is a slight gap between the lower side surface of the front flange 106 and the upper side surface 86 of the neck portion 12, a suitable tool, such as an allen wrench, is used to rotate the positioning elements 126 which extend too far from the base 80. Since the cylindrical openings 130 extend through the base 80 to the upper side surface 102 of the base (FIG. 4), the positioning elements 126 are accessible and can be adjusted with the base 80 in the groove 82. Once the positioning elements 126 have been properly adjusted, the screws 122 are again tightened to deflect the base 80 so that the front flange 106 is in abutting engagement with the upper side surface 86 of the neck portion 12 throughout the length of the front flange.

To facilitate deflection of the base 80, a plurality of rectangular slots 132 are formed in the base 80. The slots 132 extend between the front side surface 96 and a rear side surface 134 (FIG. 5) of the base 80. The longitudinal central axes of the slots 132 extend perpendicular to the front and rear side surfaces 96 and 134 of the base 80. In the illustrated embodiment of the invention, the slots 132 extend upwardly from the lower side surface 104 of the base 80 to a location which is spaced from the upper side surface 102 of the base by an amount equal to the thickness of the front and rear flanges 106 and 108.

When the base 80 is deflected from the initial linear configuration shown in FIG. 3 to the arcuate configuration shown in FIG. 6, the relatively thin portion of the base 80 extending across the upper ends of the slots 132 is elastically deformed. However, the relatively thin portion of the base 80 above the slots 132 has sufficient resistance to deflection so that the upper side surface 102 of the base has a continuous arcuately curving configuration. The continuous arcuately curving configuration of the upper side surface of the base 80 and the flange 106 corresponds to the continuous arcuately curving configuration of the upper side surface 86 on the neck portion 12.

When the base 80 is deflected to the curved configuration shown in FIG. 6, the centers of curvature of the spheres 70 and 72 are still in the plane 118 (FIG. 4). However, the centers of curvature of the spheres 70 and 72 are located along an arcuate axis having the same curvature as the upper side 102 of the base 80. The arcuate axis through the centers of the spheres 70 and 72 has the same curvature as the upper side surface 86 of the neck portion 12 and the same curvature as the upper side surfaces of the frets 64. Therefore, the centers of the spheres 70 and 72 are all located the same distance from the upper side surface 102 of the base 80 and the same distance from the upper side surface 86 of the neck portion 12.

Sphere Mounting

In accordance with another feature of the invention, a plurality of pairs of apertures 140 and 142 (FIG. 3) are formed in the base 80 and receive lower segments of the spheres 70 and 72. Thus, for each pair of spheres 70 and 72 in the string supports 50–60, there is a pair of apertures 140 and 142. The apertures 140 and 142 are engaged by the lower portions of the spheres 70 and 72 to position the spheres relative to the base 80.

The apertures 140 and 142 have a cylindrical configuration and extend through the base. The forward or front half of each of the apertures 140 and 142 is formed in the front flange 106. The rearward or back half of each of the apertures 140 and 142 extends through the body portion 110 of the base.

The central axis of each of the cylindrical apertures or openings 140 and 142 is disposed in the vertical plane 118 (FIG. 4) which contains the flat front side surface 90 of the groove 82 and the flat front side surface 96 of the base 80. This results in the forward portion of the apertures 140 and 142 having a relatively short axial extent corresponding to the thickness of the front flange 104. However, the rearward portion of the apertures 140 and 142 has a substantially greater axial extent corresponding to the thickness of the body portion 110 of the base 80.

The central axes of the cylindrical openings or apertures 140 and 142 are spaced apart by a distance which corresponds to the diameter of one of the spheres 70 or 72. Therefore, when the spheres 70 and 72 are disposed in the apertures 140 and 142 (FIG. 3), the spheres are disposed in abutting engagement to form the nip 74 (FIG. 2). Although the central axes of the apertures 140 and 142 are spaced apart by a distance which is the same as the diameter of one of the spheres 70 or 72, the apertures 140 and 142 have a diameter which is less than the diameter of the spheres. Therefore, only the lower portion of the sphere 70 is disposed in the aperture 140 and only the lower portion of the sphere 72 is disposed in the aperture 142.

Since the apertures 140 and 142 are located with their central axes in the plane 118, the centers of curvature of the spheres are positioned in the plane 118 when the spheres are disposed in engagement with the apertures. When the base 80 is deflected from the linear configuration of FIG. 3 to the arcuate configuration of FIG. 6, the central axes of the apertures 140 and 142 remain in the plane 118. Therefore, the centers of curvature of the spheres 70 and 72 remain in the plane 118. Of course, when the base 80 has the curved configuration of FIG. 6, a line through the centers of curvature of the spheres 70 and 72 for the string supports 50–60 will have a curved configuration corresponding to the curvature of the upper side surface 102 of the base 80.

The spheres 70 and 72 have the same diameter. The apertures 140 and 142 also have the same diameter. However, the apertures 140 and 142 have a smaller diameter than the spheres 70 and 72. In one specific embodiment of the invention, the apertures 140 and 142 had a diameter of 0.080 inches and the spheres 70 and 72 had a diameter of 0.093 inches. Of course, the spheres and apertures could have diameters other than these specific diameters.

The spheres 70 and 72 are fixedly secured to the base 80 so that they cannot move relative to the base. The spheres may be connected with the base 80 by bonding them to the base with a suitable solder, indicated at 146 in FIG. 4. The solder 146 is disposed in an annular body which is bonded to the outer side surface of the sphere 72 and is bonded to the upper side surface 102 of the base 80 and is bonded to the inner side surface of the aperture 142. The sphere 70 is fixedly connected with the base 80 in the same manner as in which the sphere 72 is fixedly connected with base. Of course, materials other than solder could be used to hold the spheres 70 and 72 against movement relative to the base 80.

Second Embodiment

In the embodiment of the invention illustrated in FIGS. 1–6, a plurality of string supports 50–60 are disposed on a single base 80. In the embodiment of the invention illustrated in FIG. 7, a single string support is disposed on a base.

Figure 7:
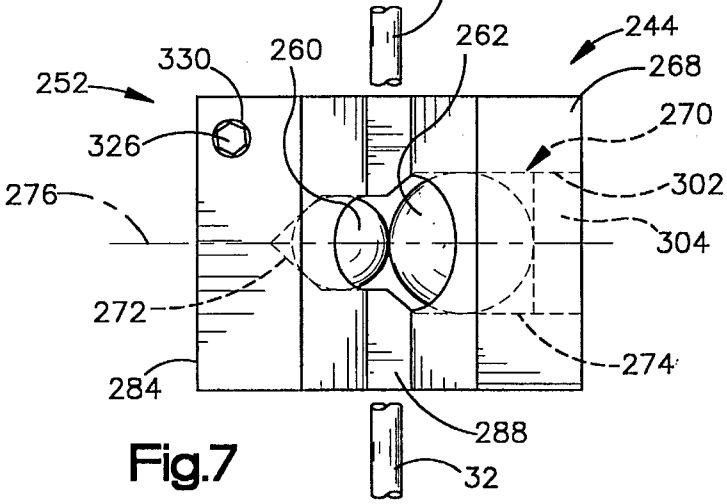
FIG. 7 is a plan view of a second embodiment of the string support and illustrating the relationship of a plurality of spheres to a base of the string support and the location of a positioning member relative to the base of the string support.

In the embodiment of the invention illustrated in FIG. 7, a string support assembly 244 includes a string support 252 for each of the strings 30–40 of the musical instrument. Thus, a string support 252 is provided for the string 32. The string support 252 positions the string 32 relative to the neck portion of a guitar in the manner previously described in conjunction with the embodiment of the invention illustrated in FIGS. 1–6. It should be understood that there is a separate string support 252 for each of the strings of the guitar.

Each string support 252 includes a pair of balls or spheres 260 and 262 (FIG. 7). The spheres 260 and 262 are formed of metal (steel) and have convex arcuate surfaces which support one of the strings, for example, the string 32. In this embodiment of the invention, the spheres 260 and 262 have different diameters. Thus, the sphere 262 is larger than the sphere 260. Although it is preferred to use a pair of spheres or balls 260 and 262 in the string support 252, either a single member or a pair of nonspherical members could be formed with convex arcuate surface areas which are engaged by the string 32.

The string support 252 includes a metal (brass) body or base 268. A recess 270 extends part way through the one-piece body or base 268. The recess 270 includes a relatively small diameter cylindrical inner end portion 272 and a relatively large diameter cylindrical outer end portion 274. The inner and outer end portions 272 and 274 and the recess 270 are disposed in a coaxial relationship.

The small sphere 260 is disposed in the inner end portion 272 of the recess 270. The large sphere 262 is disposed in the outer end portion 274 of the recess 270. The spheres 260 and 262 are disposed in the recess 270 with their centers on a central axis 276 of the recess 270.

In the embodiment of the string support 252 illustrated in FIG. 7, the inner end portion 272 and the outer end portion 274 of the recess 270 are disposed in a coaxial relationship. However, it is contemplated that the inner end portion 272 of the recess 270 could be offset from the outer end portion 274 of the recess 270.

When the string 32 is flexed during playing of the guitar 10, for example, during actuation of a tremolo, the string 32 is free to move along its longitudinal axis relative to the spheres 260 and 262. As the string 32 moves axially relative to the spheres 260 and 262, the spheres are rotated in opposite directions about their centers by forces transmitted from the string 32 to the spheres. Thus, if the string 32 was moved axially in an upward direction (as viewed in FIG. 7), the sphere 260 would rotate in a counterclockwise direction about its center while the sphere 262 would rotate in a clockwise direction about its center.

Allowing the spheres 260 and 262 to rotate under the influence of force transmitted to the spheres by the string 32 eliminates any possibility of binding or jamming of the string 32 in the string support 252. This tends to maximize the effect which can be obtained by the use of a tremolo. Of course, if desired, the spheres 260 and 262 could have an interference fit with a cylindrical inner side surface of the recess 270 so that the spheres would not rotate in the recess.

The body or base 268 of the string support 252 includes a cylindrical mounting section (not shown) which is received in a cylindrical hole or recess formed in the wooden material of the musical instrument 10. Therefore, vibrations can be transmitted directly from the string 32 to the wooden material of the instrument 10 through the string support 252. Of course, the musical instrument 10 could be formed of a material other than wood if desired.

The spheres 260 and 262 are disposed in the recess 270 formed in a rectangular sphere support section 284 of the string support 252. The rectangular sphere support section 284 is larger than the cylindrical mounting section which extends downwardly from the sphere support section.

A truncated V-shaped slot or passage 288 is formed in the rectangular sphere support section 284 of the base 268. The slot 288 extends downwardly past the longitudinal axis 276 of the recess 270 and the centers of the spheres 260 and 262. The slot 288 receives the string 32 and enables the string to move into the rectangular sphere support section 284 of the base 268 for a distance sufficient to engage the spheres 260 and 262. In addition, the slot 288 is wide enough to enable the string 32 to bend at the location where the string engages the spheres 260 and 262. The longitudinal central axis of the slot 288 extends perpendicular to the longitudinal central axis 276 of the recess 270.

The recess 270 has an open end 302 which is blocked by a circular disc-shaped piece 304. The disc-shaped piece 304 is received in the cylindrical outer end portion 270 of the recess 70. The sphere 262 is pressed against the adjacent sphere 260 by the circular disc-shaped piece 304.

The string support 252 has the same construction and is formed by the same method which is disclosed in the aforementioned co-pending patent application Ser. No. 08/068,122, filed May 25, 1993 by Robert J. Sperzel and entitled "String Support and Method".

In accordance with a feature of this embodiment of the invention, a positioning element 326 is mounted on the base 268. The positioning element 326 is externally threaded and is received in an internally threaded opening 330 which extends through the base 268. The positioning element 326 has a central axis which extends perpendicular to the central axis 276 of the recess 270 and the central axis of the slot 88. The positioning element 326 is movable relative to the base 268 to adjust the position of the base relative to the musical instrument in the same manner as previously explained in conjunction with the positioning element 126 and base 80 of the embodiment of the invention illustrated in FIGS. 1–6.

Conclusion

In view of the foregoing description it is apparent that an improved string support 44 or 244 is used in a musical instrument 10 of the guitar type. This type of musical instrument commonly has a plurality of strings 30–40 which extend from tuning devices on a head portion 14, along a neck portion, to a body portion of the instrument. The improved string support 44 or 244 positions the strings 30–40 relative to the head and neck portions of the instrument.

In one embodiment of the invention, the string support 44 includes a base 80 which extends beneath the strings 30–40. A plurality of spheres 70 and 72 are disposed on the base 80 and have lower segments which are disposed in apertures 140 and 142 formed in the base. Each of the spheres 70 and 72 has a center of curvature which is disposed in a plane 118 containing a side surface area 90 of a groove 82 in which the base 80 is disposed on the instrument 10. Positioning elements 126 extend from the base 80 and engage a bottom 88 of the groove 82 to locate the base relative to the groove. The base 80 may be deflected to have a curvature which corresponds to the curvature of an upper side surface 86 of the neck portion 12 of the instrument.

In another embodiment of the invention, a separate base 268 is provided for each pair of spheres 260 and 262. Each of the bases 268 includes a positioning member 326 which locates the base relative to the musical instrument.

Having described the invention, the following is claimed:

1. A string support for use in a stringed musical instrument and across which a plurality of strings extend, said string support comprising a base extending beneath the plurality of strings, said base having an upper side surface facing toward the plurality of strings, a plurality of pairs of apertures extending downwardly from the upper side surface of said base, a plurality of spheres connected with said base, each of said spheres having a lower segment disposed in one of said apertures and a center of curvature which is disposed above the upper side surface of said base.

2. A string support as set forth in claim 1 further including connecting material bonded to outer side surfaces of each of said spheres and to said base to fixedly interconnect said spheres and said base, said connecting material extending into each of said apertures.

3. A string support as set forth in claim 1 further including means for resiliently deflecting said base to deform said upper side surface of said base to have a configuration which corresponds to a configuration of an upper side surface of a neck portion of the musical instrument.

4. A string support as set forth in claim 1 wherein said base includes a plurality of sections, at least one of said sections being movable relative to an adjacent section to move a pair of spheres connected with the one section relative to a pair of spheres connected with the adjacent section.

5. A string support as set forth in claim 4 wherein the one section is separated from the adjacent section by a groove which extends part way through said base.

6. A string support as set forth in claim 1 further including a plurality of stop members connected with said base and having surfaces disposed adjacent to a lower side of said base to engage the musical instrument and position said base relative to the musical instrument and a plurality of connector members for securing said base to the musical instrument with said stop members in engagement with the musical instrument.

7. A string support as set forth in claim 1 wherein said base includes a plurality of openings extending into said base from said upper side surface of said base, a plurality of positioning members disposed in said openings and movable relative to said base, each of said positioning members being accessible at the upper side surface of said base to enable the position of each of said positioning members relative to said base to be adjusted to adjust the position of at least some of said spheres relative to the musical instrument.

8. A string support for use in a musical instrument and across which a plurality of strings extend, said string support comprising a base, a plurality of pairs of spheres disposed on said base in engagement with said plurality of strings, means for holding spheres of each pair of spheres of said plurality of pairs of spheres adjacent to each other while the plurality of strings press against said plurality of pairs of spheres, and means for forming an area of reduced thickness in said base to enable said base to be deflected to move at least one of said pairs of spheres of said plurality of pairs of spheres relative to the musical instrument.

9. A string support as set forth in claim 9 wherein said area of reduced thickness includes a groove extending from a lower side surface of said base toward an upper side surface of said base.

10. A string support as set forth in claim 9 wherein said base includes a plurality of pairs of apertures extending downwardly from the upper side surface of said base, each of said spheres having a lower segment disposed in one of said apertures and a center of curvature which is disposed above the upper side surface of said base.

11. A string support as set forth in claim 8 further including a plurality of stop members connected with said base and having surfaces disposed adjacent to a lower side of said base to engage the instrument and position said base relative to the instrument and a plurality of connector members for securing said base to the musical instrument with said stop members in engagement with the musical instrument.

12. A stringed musical instrument said musical instrument comprising a body portion, a neck portion connected with and extending outwardly from said body portion, a head portion connected with said neck portion, a plurality of tuning devices mounted on said head portion, a plurality of strings each of which extends from one of said tuning devices along said neck portion and body portion of said musical instrument, a groove formed in said musical instrument adjacent to the connection between said head portion and neck portion, said groove having a side surface area disposed in a plane which extends transversely to longitudinal axes of said strings, a base at least partially disposed in said groove and extending beneath said strings, a plurality of pairs of spheres disposed on said base, each string of said plurality of strings being disposed in engagement with a pair of spheres of said plurality of pairs of spheres, each of the spheres of said plurality of pairs of spheres having a center of curvature which is disposed in the plane containing the side surface area of said groove.

13. A stringed musical instrument as set forth in claim 12 wherein said base includes a surface area which is disposed in abutting engagement with the side surface area of said groove to locate said base relative to said musical instrument.

14. A stringed musical instrument as set forth in claim 12 wherein said groove has a bottom surface area which extends transversely to the side surface area of said groove, said base having a lower side surface area which is at least partially spaced apart from the bottom surface area of said groove, and a plurality of positioning members extending downwardly from said base into engagement with the bottom surface area of said groove to locate said base relative to said groove.

15. A stringed musical instrument as set forth in claim 14 wherein said base includes a plurality of passages which extend through said base, each of said positioning members being disposed in one of the passages and being accessible from an upper side of said base to enable the locations of said positioning members in the passages to be adjusted while said base is in said groove.

16. A stringed musical instrument as set forth in claim 12 wherein said base includes a plurality of sections which are interconnected, at least one of said sections being movable relative to an adjacent section to move a first pair of spheres connected with the one section relative to a second pair of spheres connected with the adjacent section while centers of curvature of the first pair of spheres remain in the plane containing the side surface area of the groove.

17. A stringed musical instrument as set forth in claim 12 further including a plurality of grooves formed in said base, each of said grooves formed in said base having a longitudinal central area axis which extends perpendicular to the plane containing the side surface area of said groove in said musical instrument.

18. A stringed musical instrument said musical instrument comprising a body portion, a neck portion connected with and extending outwardly from said body portion, a head portion connected with said neck portion, a plurality of tuning devices mounted on said head portion, a plurality of strings each of which extends from one of said tuning devices along said neck portion and body portion of said musical instrument, said neck portion having a curved side surface which faces toward said plurality of strings, a base mounted on said musical instrument and extending beneath said strings, a plurality of pairs of spheres disposed on said base, each string of said plurality of strings being disposed in engagement with a pair of spheres of said plurality of pairs of spheres, and means for deflecting said base from a first condition in which the centers of curvature of the spheres of said plurality of spheres are disposed along a first axis having a first configuration to a second condition in which the centers of curvature of the spheres of said plurality of spheres are disposed along a second axis having a second configuration which corresponds to the configuration of the curved side surface of said neck portion.

19. A stringed musical instrument as set forth in claim 18 further including a groove formed in said musical instrument adjacent to the connection between said head portion and said neck portion, said groove having a side surface disposed in a plane which extends transversely to longitudinal axes of said strings, said first and second axes being disposed in the plane containing the side surface of the groove.

20. A stringed musical instrument as set forth in claim 18 further including a plurality of pairs of apertures extending from an upper side of said base which faces toward said plurality of strings, each of said spheres of said plurality of pairs of spheres having a segment disposed in one of said apertures, each of said apertures having a central axis which intersects said second axis.

21. A stringed musical instrument as set forth in claim 18 further including a groove formed in said musical instrument adjacent to the connection between said head portion and neck portion, said groove having a bottom surface area which faces toward said plurality of strings, said base having a lower side surface area which is at least partially spaced apart from the bottom surface area of said groove, and a plurality of positioning members extending downward from said base into engagement with the bottom surface area of said grove to locate said base relative to said groove.

22. A stringed musical instrument as set forth in claim 21 wherein said base includes a plurality of passages which extend through said base, each of said positioning members being disposed in one of the passages and being accessible from an upper side of said base to enable the locations of said positioning members in the passages to be adjusted while said base is in the groove.

23. A method of mounting a string support in a groove formed in a musical instrument which is has a neck portion with a curved upper side surface, said method comprising the steps of positioning a portion of a base of the string support in the groove with a plurality of spheres on the base, and deflecting the string support while the string support is in the groove, said step of deflecting the string support including changing the configuration of an axis extending through centers of the plurality of spheres disposed on the base of the string support from a first configuration to a second configuration which corresponds to the configuration of the curved upper side surface of the neck portion of the musical instrument.

24. A method as set forth in claim 23 wherein said step of positioning the base of the string support in the groove includes positioning the base of the string support in the groove with the axis extending through the centers of the plurality of spheres disposed in a plane containing a side surface of the groove, whereby said base being disposed in the groove with the axis extending through the centers of the plurality of spheres disposed in the plane containing a side surface of the groove after performing said step of deflecting the string support.

25. A method as set forth in claim 23 wherein said step of deflecting the base of the string support includes moving at least a portion of a flange on the base of the string support into engagement with the curved upper side surface of the neck portion of the musical instrument.

26. A method comprising the steps of providing a musical instrument having a groove with a flat side surface adjacent to a connection between a head portion and a neck portion of the musical instrument, and positioning a string support in the groove, said step of positioning a string support in the groove including positioning a flat surface of a base portion of the string support in engagement with a flat side surface of the groove and positioning a plurality of spheres disposed on the base portion of the string support in locations in which centers of the spheres are disposed in a plane containing the flat side surface of the groove.

27. A stringed musical instrument, said musical instrument comprising a body portion, a neck portion connected with and extending outwardly from said body portion, a head portion connected with said neck portion, a plurality of tuning devices mounted on said head portion, a plurality of strings each of which extends from one of said tuning devices along said neck portion and body portion of said musical instrument, said neck portion having an arcuately curved upper side surface which faces toward said plurality of strings, a groove formed in said musical instrument adjacent to the connection between said head portion and neck portion, said groove having a side surface area disposed in a plane which extends transversely to longitudinal axes of said strings, a base at least partially disposed in said groove and extending beneath said strings, said base having an upper side surface which faces toward said plurality of strings, means for deflecting said base so that the upper side surface of said base has a configuration which corresponds to the arcuately curved configuration of said upper side surface of said neck portion, a plurality of pairs of spheres disposed on said base, each string of said plurality of strings being disposed in engagement with a pair of spheres of said plurality of pairs of spheres, each of the spheres of said plurality of pairs of spheres having a center of curvature which is disposed in the plane containing the side surface area of said groove.

28. A stringed musical instrument, said musical instrument comprising a body portion, a neck portion connected with and extending outwardly from said body portion, a head portion connected with said neck portion, a plurality of tuning devices mounted on said head portion, a plurality of strings each of which extends from one of said tuning devices along said neck portion and body portion of said musical instrument, a groove formed in said musical instrument adjacent to the connection between said head portion and neck portion, said groove having a side surface area disposed in a plane which extends transversely to longitudinal axes of said strings, a base at least partially disposed in said groove and extending beneath said strings, a plurality of pairs of spheres disposed on said base, a plurality of pairs of apertures extending from an upper side of said base which faces toward said plurality of strings, each sphere of said plurality of pairs of spheres having a lower segment disposed in one of said apertures, each of said apertures having a center which is disposed in the plane containing the side surface area of said groove, each string of said plurality of strings being disposed in engagement with a pair of spheres of said plurality of pairs of spheres, each of the spheres of said plurality of pairs of spheres having a center of curvature which is disposed in the plane containing the side surface area of said groove.

29. A stringed musical instrument, said musical instrument comprising a body portion, a neck portion connected with and extending outwardly from said body portion, a head portion connected with said neck portion, a plurality of tuning devices mounted on said head portion, a plurality of strings each of which extends from one of said tuning devices along said neck portion and body portion of said musical instrument, a groove formed in said musical instrument adjacent to the connection between said head portion and neck portion, said groove having a side surface area disposed in a plane which extends transversely to longitudinal axes of said strings, a base at least partially disposed in said groove and extending beneath said strings, a plurality of pairs of spheres disposed on said base, each string of said plurality of strings being disposed in engagement with a pair of spheres of said plurality of pairs of spheres, each of the spheres of said plurality of pairs of spheres having a center of curvature which is disposed in the plane containing the side surface area of said groove, and means for resiliently deflecting said base to deform an upper side surface of said base which faces toward said plurality of strings while maintaining said base in engagement with the side surface area of said groove.

30. A stringed musical instrument as set forth in claim 29 wherein said base includes a side surface area which is disposed in abutting engagement with the side surface area of said groove to locate said base relative to said neck portion of said musical instrument.

31. A stringed musical instrument as set forth in claim 29 wherein said groove has a bottom surface area which extends transversely to the side surface area of said groove, said base having a lower side surface area which is at least partially spaced apart from the bottom surface area of said groove, and a plurality of positioning members extending downwardly from said base into engagement with the bottom surface area of said groove to locate said base relative to said groove.

32. A stringed musical instrument as set forth in claim 31 wherein said base includes a plurality of passages which extend through said base, each of said positioning members being disposed in one of the passages and being accessible from an upper side of said base to enable the locations of said positioning members in the passages to be adjusted while said base is in said groove.

33. A stringed musical instrument as set forth in claim 29 further including, a plurality of pairs of apertures extending from an upper side of said base, each sphere of said plurality of pairs of spheres having a lower segment disposed in one of said apertures, each of said apertures having a center which is disposed in the plane containing the side surface area of said groove.

34. A stringed musical instrument as set forth in claim 29 wherein said base includes a plurality of sections which are interconnected, at least one of said sections being movable relative to an adjacent section to move a first pair of spheres connected with the one section relative to a second pair of spheres connected with the adjacent section while centers of curvature of the first pair of spheres remain in the plane containing the side surface area of the groove.

35. A stringed musical instrument as set forth in claim 29 further including a plurality of grooves formed in said base, each of said grooves formed in said base having a longitudinal central area axis which extends perpendicular to the plane containing the side surface area of said groove in said musical instrument.

36. A method comprising the steps of providing a musical instrument with a groove having a flat side surface adjacent to a connection between a head portion and a neck portion of the musical instrument, positioning at least a portion of a string support in the groove, said step of positioning a string support in the groove including positioning a flat surface area on a base portion of the string support in engagement with a flat side surface of the groove and positioning a plurality of spheres disposed on the base portion of the string support in locations in which centers of the spheres are disposed in a plane containing the flat side surface of the groove, and deflecting the base portion of the string support while at least a portion of the string support is in the groove to change the configuration of the base portion of the string support.

37. A method as set forth in claim 36 wherein said step of positioning at least a portion of the string support in the groove includes positioning the base portion of the string support with an axis extending through the centers of the plurality of spheres disposed in a plane containing the flat side surface of the groove, said base portion of the string support being at least partially disposed in the groove with the axis extending through the centers of the plurality of spheres disposed in the plane containing the flat side surface of the groove after performing said step of deflecting the base portion of the string support.

38. A method as set forth in claim 36 wherein said step of deflecting the base portion of the string support includes moving at least a portion of the base portion of the string support into engagement with a curved upper side surface of the neck portion of the musical instrument.

39. A string support for use in a musical instrument and across which a plurality of strings extend, said string support comprising a base, a plurality of pairs of members disposed on said base in engagement with said plurality of strings, each member of said plurality of pairs of members having an outer side surface which has a circular cross sectional configuration, means for holding members of each pair of members of said plurality of pairs of members adjacent to each other while the plurality of strings press against the outer side surfaces of the members of said plurality of pairs of members, and means for forming an area of reduced thickness in said base at a location between a first pair of members of said plurality of pairs of members and a second pair of members of said plurality of pairs of members to enable said base to be deflected to move at least one of said pairs of members of said plurality of pairs of members relative to the musical instrument.

40. A string support as set forth in claim 39 wherein said area of reduced thickness includes a groove extending from a lower side surface of said base toward an upper side surface of said base.

41. A string support as set forth in claim 40 wherein said base includes a plurality of pairs of apertures extending downwardly from the upper side surface of said base, each of said members having a lower portion disposed in one of said apertures.

42. A string support as set forth in claim 39 further including a plurality of stop members connected with said base and having surfaces disposed adjacent to a lower side of said base to engage the instrument and position said base relative to the instrument and a plurality of connector members for securing said base to the musical instrument with said stop members in engagement with the musical instrument.

43. A method comprising the steps of providing a musical instrument having a groove adjacent to a connection between a head portion and a neck portion of the musical instrument, providing a string support having an upper side surface with a plurality of pairs of apertures in which a plurality of pairs of members are mounted, each of the members of the plurality of pairs of members extends into one of the apertures of the plurality of pairs of apertures, positioning at least a portion of the string support in the groove, deflecting the string support while the string support is at least partially disposed in the groove, said step of deflecting the string support being performed while the plurality of pairs of members extend into the apertures in the upper side surface of the string support, said step of deflecting the string support includes changing the configuration of the upper side surface of the string support from a first configuration to a second configuration which corresponds to a configuration of a curved upper side surface of the neck portion of the musical instrument, and, thereafter, positioning a plurality of strings in engagement with the plurality of pairs of members, said step of positioning the plurality of strings in engagement with the plurality of pairs of members includes positioning a string in engagement with each pair of members of the plurality of pairs of members.

44. A string support for use in a stringed musical instrument and across which a plurality of strings extend, said string support comprising a base extending beneath the plurality of strings, a plurality of pairs of apertures formed in said base, a plurality of spheres, each of said spheres having a segment disposed in one of said apertures, and connecting material bonded to outer side surfaces of each of said spheres and to said base to fixedly interconnect said spheres and said base, said connecting material extending into each of said apertures.

45. A string support as set forth in claim 44 further including means for resiliently deflecting said base to deform said base to have a configuration which corresponds to a configuration of an upper side surface of a neck portion of the musical instrument.

46. A string support as set forth in claim 44 wherein said base includes a plurality of sections, at least one of said sections being movable relative to an adjacent section to move a pair of spheres connected with the one section relative to a pair of spheres connected with the adjacent section.

47. A string support as set forth in claim 46 wherein the one section is separated from the adjacent section by a groove which extends part way through said base.

48. A string support as set forth in claim 44 further including a plurality of stop members connected with said base and having surfaces disposed adjacent to a lower side of said base to engage the musical instrument and position said base relative to the musical instrument and a plurality of connector members for securing said base to the musical instrument with said stop members in engagement with the musical instrument.

49. A stringed musical instrument, said musical instrument comprising a neck portion, said neck portion having an arcuately curved outer side surface, a head portion connected with said neck portion, a plurality of tuning devices mounted on said head portion, a plurality of strings each of which extends from one of said tuning devices along said arcuately curved outer side surface of said neck portion, a base extending beneath said strings, a plurality of pairs of members disposed on said base, each member of said plurality of pairs of members having an outer side surface which has a circular cross sectional configuration, each string of said plurality of strings being disposed in engagement with outer side surfaces of a pair of members of said plurality of pairs of members, and means for connecting said base with said head and neck portions of said musical instrument and for deflecting said base from a first configuration to a second configuration which corresponds to the configuration of said arcuately curved outer side surface of said neck portion.

50. A stringed musical instrument as set forth in claim 49 wherein said base includes a surface area which is disposed in abutting engagement with said arcuately curved outer side surface of said neck portion.

51. A stringed musical instrument as set forth in claim 49 further including a groove formed in said musical instrument adjacent to a connection between said head portion and said neck portion, said groove having a side surface area disposed in a plane which extends transversely to longitudinal axes of said strings, said base having a first portion which extends into said groove to position said base relative to said neck portion of said musical instrument, said base having a second portion which is disposed outside of said grove and is disposed in engagement with said arcuately curved outer side surface of said neck portion.

52. A stringed musical instrument as set forth in claim 51 wherein said groove has a bottom surface area which extends transversely to the side surface area of said groove, said base having a lower side surface area which is at least partially spaced apart from the bottom surface area of said groove, said means for connecting said base with said head and neck portions and for deflecting said base including a plurality of retaining members which extend from said base and through the bottom surface area of said groove.

53. A stringed musical instrument, said musical instrument comprising a neck portion, a head portion connected with said neck portion, a plurality of tuning devices mounted on said head portion, a plurality of strings each of which extends from one of said tuning devices along said neck portion, said neck portion having an arcuately curved upper side surface which faces toward said plurality of strings, a groove formed in said musical instrument adjacent to the connection between said head portion and said neck portion, said groove having a side surface area disposed in a plane which extends transversely to longitudinal axes of said strings, a base at least partially disposed in said groove and extending beneath said strings, said base having a first surface area which is disposed in abutting engagement with the side surface area of said groove to locate said base relative to said neck portion of said musical instrument, said base having a second surface area which faces toward said plurality of strings, said base having a third surface area which is disposed in engagement with said arcuately curved upper side surface of said neck portion, and a plurality of pairs of members disposed on said base, each string of said plurality of strings being disposed in engagement with a pair of members of said plurality of pairs of members.

54. A stringed musical instrument as set forth in claim 53 wherein said groove has a bottom surface area which extends transversely to the side surface area of said groove, said base having a fourth surface area which is at least partially spaced apart from and faces toward the bottom surface area of said groove, and a plurality of retaining members extending downwardly from said base through the bottom surface area of said groove to connect said base with said neck portion and said head portion of said musical instrument.

55. A stringed musical instrument as set forth in claim 53 further including means for deflecting said base from a first configuration to a second configuration in which the second surface area and the third surface area of said base have configurations which correspond to the arcuately curved configuration of said upper side surface of said neck portion.

56. A stringed musical instrument as set forth in claim 53 further including a plurality of pairs of apertures extending from the second surface area of said base toward the third surface area of said base, each of said members of said plurality of pairs of members having a lower portion disposed in one of said apertures, each of said apertures having a center which is disposed in the plane containing the side surface area of said groove.

57. A stringed musical instrument as set forth in claim 53 further including means for resiliently deflecting said base to deform the second surface area of said base while maintaining said base in engagement with the side surface area of said groove.

* * * * *

UNITED STATES PATENT AND TRADEMARK OFFICE

CERTIFICATE OF CORRECTION

PATENT NO. : 5,492,044

DATED : February 20, 1996

INVENTOR(S) : Robert J. Sperzel

It is certified that error appears in the above-indentified patent and that said Letters Patent is hereby corrected as shown below:

Column 14, line 14, after "which" delete --is--.

Column 18, line 51, change "grove" to --groove--.

Signed and Sealed this

Thirteenth Day of August, 1996

*Attest:*

Bruce Lehman

BRUCE LEHMAN

*Attesting Officer*

*Commissioner of Patents and Trademarks*